United States Patent [19]

Noble

[11] Patent Number: 4,523,583

[45] Date of Patent: Jun. 18, 1985

[54] BACK EXERCISING DEVICE

[76] Inventor: James R. Noble, Mountain Rd., Henderson R.D. 1., Auckland, New Zealand

[21] Appl. No.: 485,465

[22] Filed: Apr. 8, 1983

[30] Foreign Application Priority Data

Apr. 30, 1982 [NZ] New Zealand ..... 200465

[51] Int. Cl.[3] ..... A61H 1/02

[52] U.S. Cl. ..... 128/71; 128/75

[58] Field of Search ..... 128/70–71, 128/75, 25 R, 84 R, 84 C, 133–134; 272/134, 143–145, 138–139; 119/103, 126

[56] References Cited

U.S. PATENT DOCUMENTS

| | | | |
|---|---|---|---|
| D. 182,957 | 6/1958 | Harris . | |
| D. 210,083 | 2/1968 | Werner . | |
| D. 224,422 | 7/1972 | Beach . | |
| D. 262,227 | 12/1981 | Dryden . | |
| 933,170 | 9/1909 | Galbreath | 128/70 |
| 1,479,165 | 1/1924 | Zilen . | |
| 1,953,857 | 4/1934 | Hunter . | |
| 2,046,653 | 7/1936 | Petcoff . | |
| 2,335,290 | 11/1943 | Medaris | 128/25 R |
| 2,343,204 | 2/1944 | Paton | 272/144 |
| 2,703,080 | 3/1955 | Sanders | 128/71 |
| 2,938,572 | 5/1960 | Solloway et al. . | |
| 3,063,447 | 11/1962 | Kristen | 128/134 |
| 3,378,259 | 4/1968 | Kupchinski . | |
| 3,404,679 | 10/1968 | Bevilacqua | 128/71 |
| 3,920,240 | 11/1975 | Ross . | |
| 4,002,165 | 1/1977 | Lind | 128/71 |
| 4,102,336 | 7/1978 | Wiener et al. | 128/75 |
| 4,198,044 | 4/1980 | Holappa . | |

*Primary Examiner*—Richard J. Johnson

*Attorney, Agent, or Firm*—Young & Thompson

[57] ABSTRACT

A back exercising device has structure enabling a patient to restrain a lower region of his spine and/or pelvis, while the upper portion of the spine is extended. The use of the equipment for the McKenzie exercise in the extension of the upper lumbar segments is described, together with the use of one form of the apparatus for exercises involving extension of the thoracic spine. The device includes a support for supporting at least a part of a patient's body substantially horizontally. The support includes pressure portions at opposite sides of the support at or adjacent one end thereof, and a strap for restraining an intermediate portion of the patient's body, so that a prone patient can push on the pressure portions to extend the upper lumbar segments at the same time that movement of the intermediate portion of the body is restrained. The pressure portions are elongated members or portions which extend lengthwise of the device on opposite sides of the device.

3 Claims, 10 Drawing Figures

BACK EXERCISING DEVICE

This invention relates to a back exercising device, and has particular application to the provision of a device suitable for use in enabling a patient to carry out back exercises on his own.

Many exercise boards, frames and tables have been devised for the carrying out of gymnastic and fitness exercises, and examples of patents detailing such equipment include the following U.S. Patents and Design Patents: U.S. Pat. No. De. 182,957, U.S. Pat. No. De. 210,083, U.S. Pat. No. De. 224,422, U.S. Pat. No. De. 262,227, U.S. Pat. Nos. 1,479,165, 1,953,857, 2,046,653, 2,938,572, 3,378,259, 3,920,240, 4,198,044.

None of these prior devices are suitable for patients suffering from back strain or back injury and requiring to carry out exercises on their own.

It is an object of this invention to provide an exercising device which can be used by a patient in a simple and convenient manner.

In one aspect, the invention provides a back exercising device including a support, and means for restraining a lower region of a patient's spine and/or the patient's pelvis, enabling the extension of an upper region of the patient's spine whilst movement of the lower region and/or pelvis is restrained.

Such a device is particularly suited to the carrying out of the McKenzie exercise involving the extension of the upper lumbar segments whilst the lower lumbar segments and/or the pelvis is restrained against extension. This exercise is carried out whilst the patient is in the prone position and relies on the patient pushing against a supporting surface to extend his upper lumbar spine. The apparatus of this invention is also suited to the exercising of the thoracic spine with the use of a thoracic wedge.

These and other aspects of the invention will become apparent from the following description, which is given by way of example only, with reference to the accompanying drawings, in which.

A back exercising device 10 is in the form of an exercise board, and is conveniently formed by providing a resilient layer of material over a substantially rigid support frame (not shown). This is conveniently achieved by using a high density foam plastics material providing a support surface 11.

Restraining means 12 is provided about the mid portion of the support, whilst pressure portions 13 are provided at the forward end of the support. These pressure portions conveniently take the form of contoured slopes on the sides of the support enabling a patient to push against these portions with his hands, forearms or elbows.

The support is conveniently formed in two portions, 15 and 16 having a plug and socket connection enabling the two portions to be readily separated for transport, and easily connected together when required for use.

Figure 4:
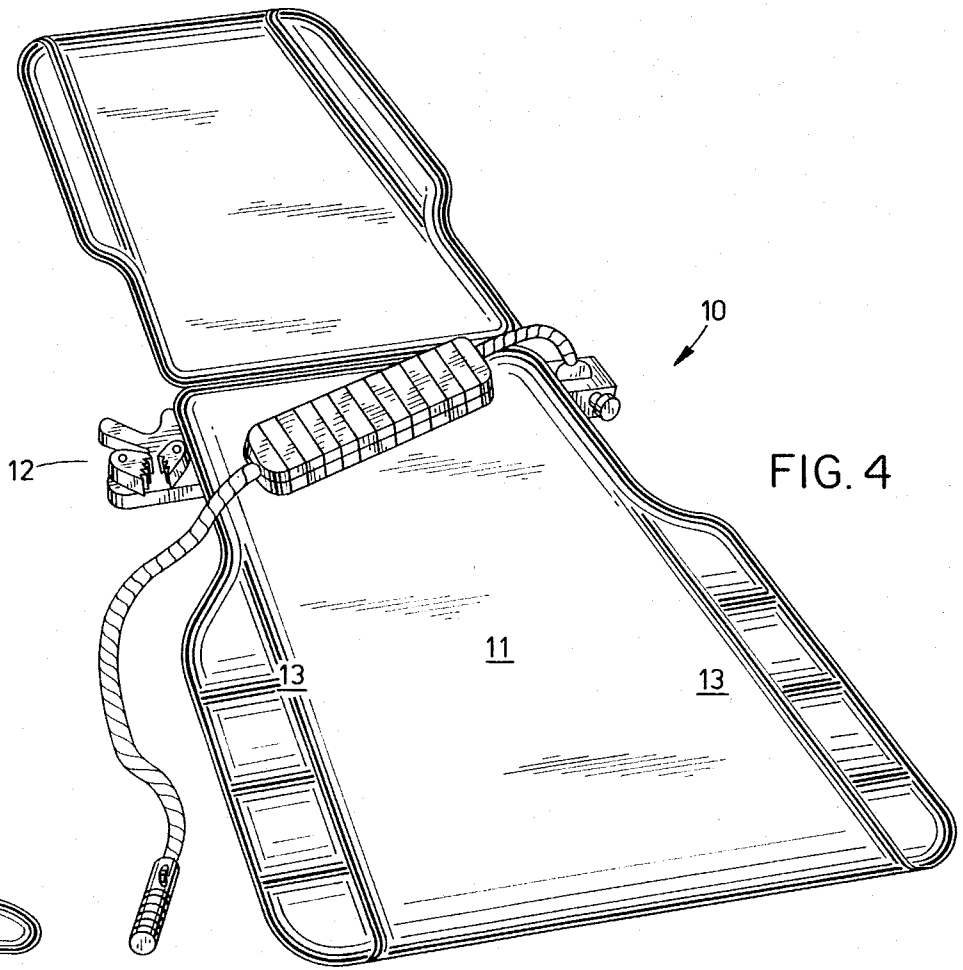
FIG. 4 illustrates the device in perspective.

The restraining means 12 is provided about the mid portion of the support, which is conveniently adjacent the division 17 between the two portions. The restraining means conveniently takes the form of a flexible strap or the like attached at end 20 on one side of the support, and attachable to the other side by quick release means 21. As shown, the strap consists of a cord 22 and a flexible pad 23 through which the cord passes. The pad 23 is conveniently formed of a flexible foam plastics material which can be pulled tight against the patient's body. The quick release means 21 consists of a pin 24 and a jam cleat 25. This is of the quick release type, which can be released by pulling the cord 22 upwardly to pull the cord out of the jaws of the cleat. This is best seen from FIG. 4. The cord 22 is provided with a handle 26, and this handle can be hollow enabling surplus cord to be stored therein.

The cord 22 can also be detached from the connection 20 by means of a quick release mechanism 27. This has a spring loaded pin fitting into a body which receives an end of the cord having a spool thereon, which can be released by moving the pin 27 so that it clears the body of the spool enabling the cord to be pulled free. It is desirable to allow the cord to be released from either end, as the patient may find it more convenient to release one side than the other particularly if the carrying out of the exercises is at all painful.

Figure 2:
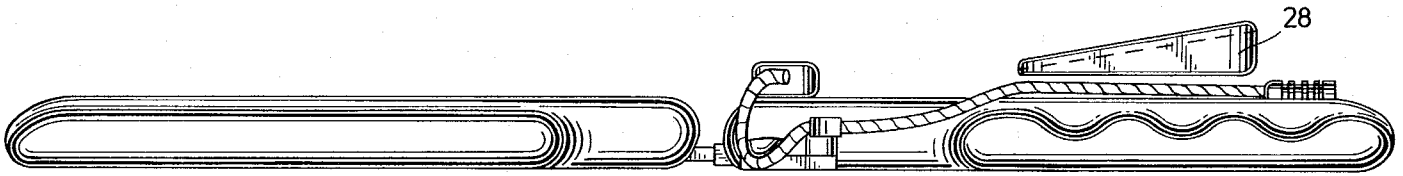
FIG. 2 illustrates a side elevation of the device of FIG. 1.
Figure 1:
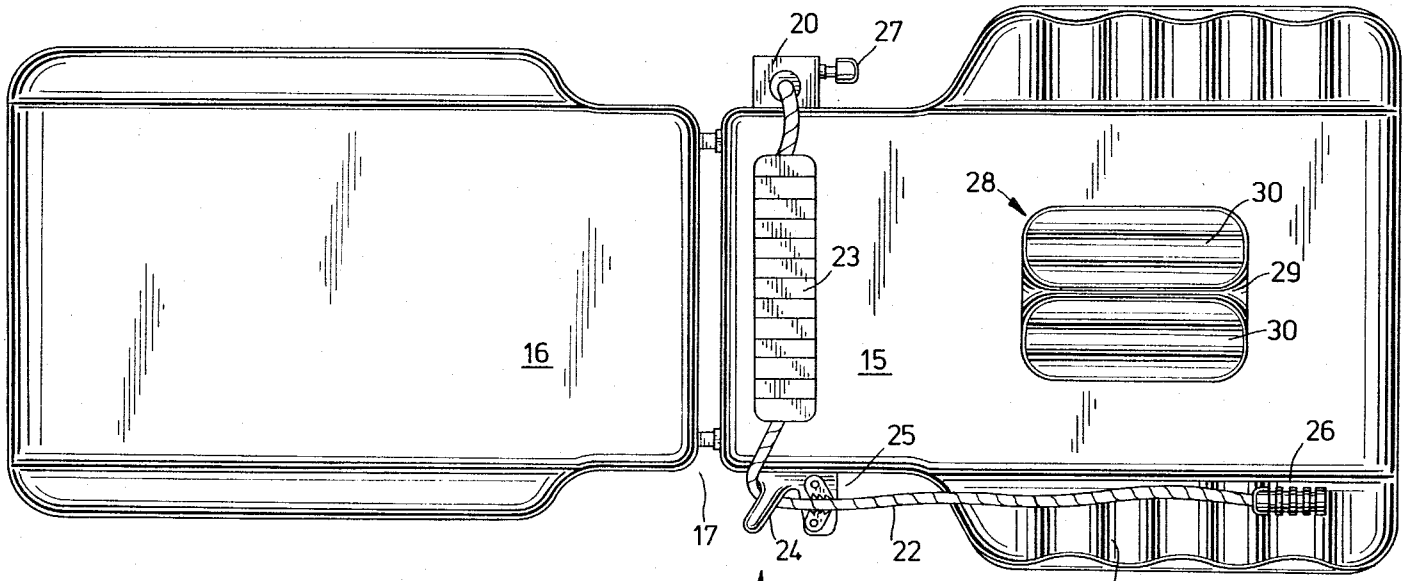
FIG. 1 illustrates a top plan view of the first back exercising device.
Figure 5:
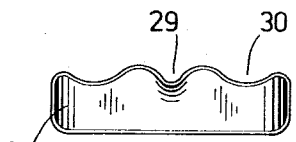
FIG. 5 illustrates an end elevation of the thoracic wedge shown in FIGS. 1 and 2.
Figure 3:
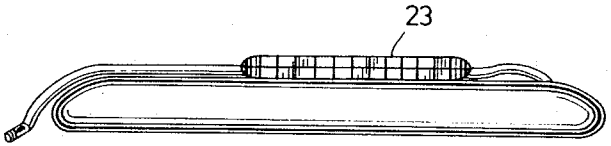
FIG. 3 illustrates an end elevation of the device.

A thoracic wedge 28 is shown in FIGS. 1, 2 and 5 (it is shown sitting above the support in FIG. 2, although when in use it will rest on the support 11 as shown in FIG. 1). This wedge 28 conveniently has a channel 29 for reception of the patient's spine and additional recesses 30 on either side thereof for the reception of the patient's muscles lying alongside the spine.

In use, a patient can lie in the prone position on the device with his lower body on portion 16, his pelvis adjacent the restraining means 12, and his hands, forearms or elbows on the pressure areas 13 on the sides of the upper portion of the support. In this position, the patient can then attach the cord 22 under the pin 24, and pulling it downwardly and forwardly into engagement with the jam cleat 25. In this position, the user can exercise his back by pressing on the pressure points 13, thereby placing pressure on the support, and thus extending his upper lumbar segments whilst keeping the lower lumbar segments and/or pelvis restrained against movement. The patient can quickly and easily release the strap from either side and readily transport the device by dismantling it into its two components.

Figure 6:
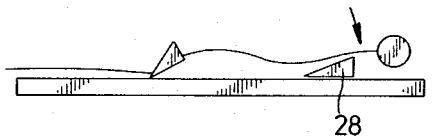
FIG. 6 illustrates a schematic side elevation showing a patient exercising his thoracic spine.

In addition to carrying out the McKenzie exercise described in the previous paragraph, a patient can use the device in conjunction with a thoracic wedge 28 to extend and exercise his thoracic spine. This is shown schematically in FIG. 6 in which the patient lies in the supine position and conveniently anchors the strap across his pelvis, whilst lying on the thoracic wedge, and then moving his upper spine downwardly and backwardly to extend the thoracic spine.

Figure 10:
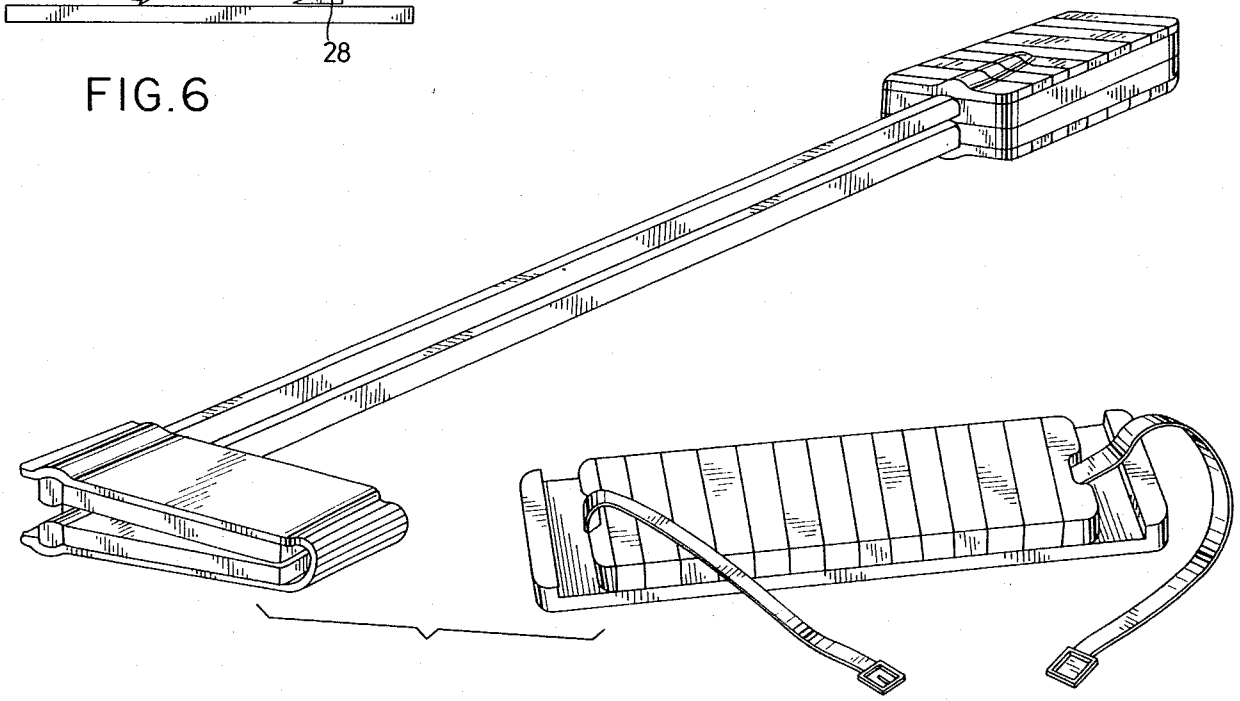
FIG. 10 shows the second form of the invention in its collapsed state.
Figures 7, 9:
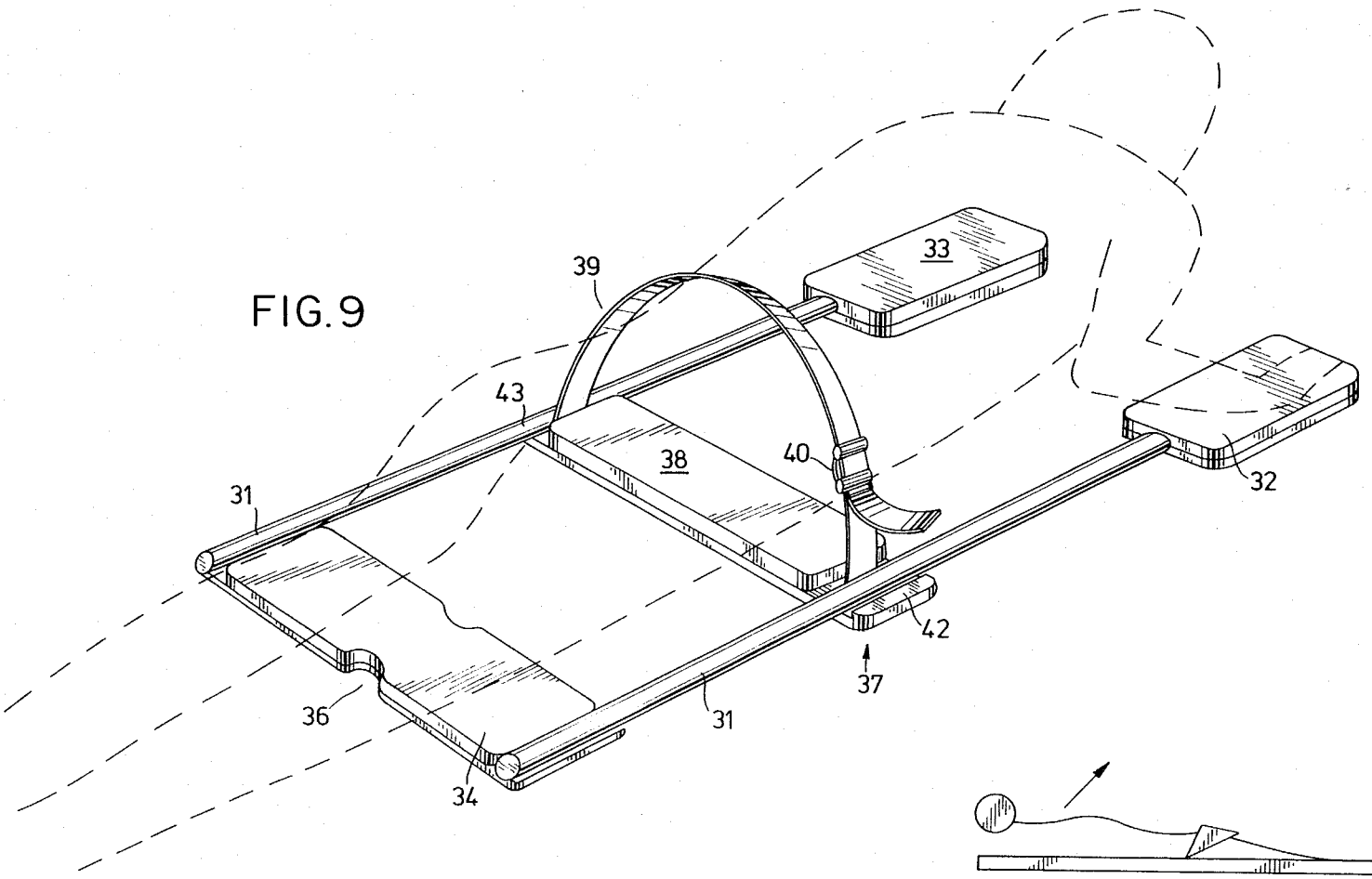
FIG. 7 is a schematic side elevation showing a patient exercising his upper lumbar spine.
FIG. 9 shows how the second form of the invention is used by a patient to carry out the McKenzie exercise.
Figure 8:
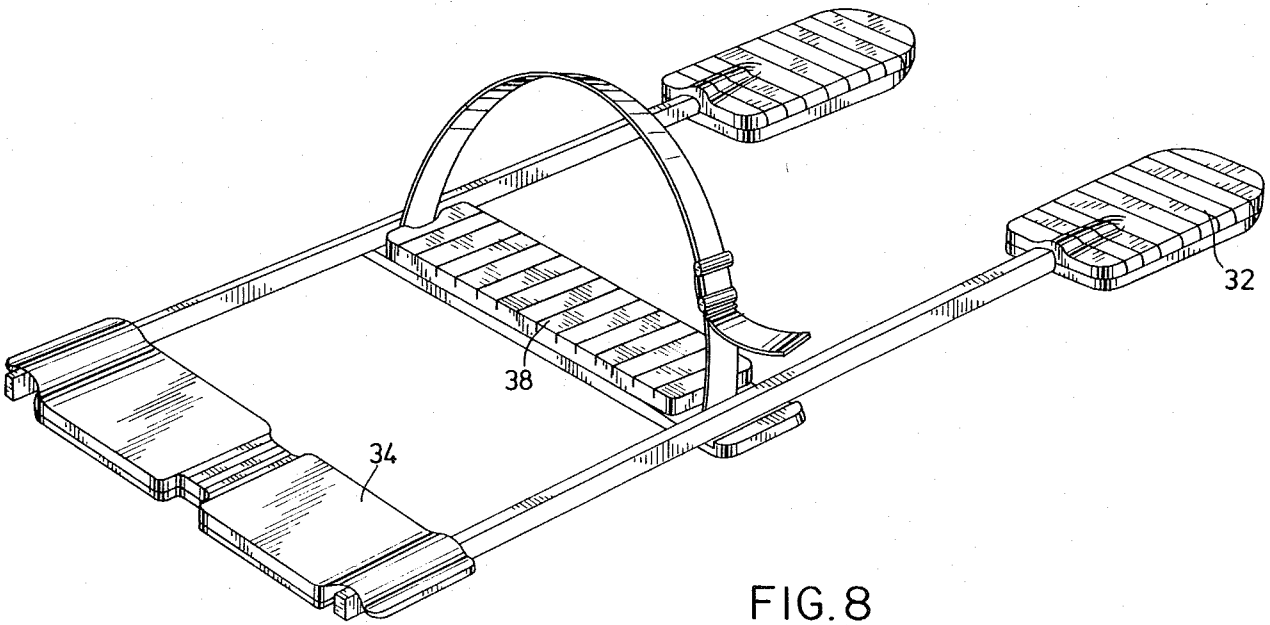
FIG. 8 is a perspective view of a second form of this invention.

Turning now to FIGS. 8 through 10, there is illustrated a second back exercising device embodying this invention. This is a somewhat smaller unit having a pair of frame members 31 having hand portions 32, 33 at the forward end thereof. The frame members 31 are connected together by a linkage member which conveniently takes the form of a pad 34 of a hinged or flexible material enabling the device to be folded about a central portion 36. Conveniently, this pad is notched at 36 to provide for ease of folding and enable the frame members to be moved outwardly from one another, as will be described below. Restraining means 37 is provided by a separately attachable pad 38 having an associated strap 39. The strap has a buckle or the like 40 enabling two portions of the strap to be engaged about a patient's body. Each end of the strap is attached to the base of the pad 38. This pad has lateral extensions 42, 43, having grooves therein capable of receiving the frame members 31. These lateral extensions 42, 43 can thus be trapped by placing the frame members 31 thereon. This is shown in FIGS. 8 and 9.

Turning now to FIG. 9, in use the patient can place the restraining portion on his body with the pad 38 across the front of his waist with the straps 39 around the back of his waist and engaged and pulled tight by the buckle 40. The frame is then placed on a surface such as the floor, and the hand portions 32, 33, pushed apart so that initially, the frame members 31 at their forward ends are more widely spaced than that illustrated in FIGS. 8 or 9. The patient can then lie on the floor, work his legs over pad 34, and the pad 38 now on the floor. In this position the patient can then move the side frames 31 inwardly until they are placed on top of the grooves on the lateral extensions 42 and 43. The patient is now ready to commence his exercises, and by pushing on the pads 32, 33, the upper lumbar segments can be exercised as the pelvis is restrained against upward movement as it is held by the strap 39 which in turn is held against the ground by the pressure on the frame members 31.

The patient may readily release himself from the exercise device, by reversing the above operations. The device is readily portable, as the frame members can be folded together as shown in FIG. 9. The pad 38 can be stored or transported, held parallel to the frame members 31 and thus the device takes up a minimum of space when not required for use.

If the patient requires to exercise his thoracic spine, then the apparatus can be used in conjunction with a thoracic wedge, which in this case would conveniently be of somewhat deeper section than the wedge used in conjunction with the first form of this invention.

Finally, it will be appreciated that various alterations and modifications may be made to the foregoing without departing from the scope of this invention as exemplified by the following claims.

I claim:

1. A lightweight portable back exercising device which is substantially planar on both sides, including a flat support that lies flat on the floor for supporting at least part of a patient's body substantially horizontally with the patient lying on his stomach, the support including pressure portions at opposite sides of the support at one end thereof, and restraining means comprising a back strap that extends across the support with slack for restraining the midportion of the patient's body, so that a prone patient lying on his stomach can push on said pressure portions to extend his upper lumbar segments whilst movement of the midportion of his body is restrained by said back strap, said pressure portions being flat and padded and elongated in the direction of the length of the patient's body and resting flat on the floor.

2. A back exercising device as claimed in claim 1, said pressure portions being integral with the support and comprising edge portions of the support and having undulant upper surfaces against which the patient can press.

3. A back exercising device as claimed in claim 1, said pressure portions comprising padded members elongated in the direction of the length of the patient's body and supported by frame members extending lengthwise in said direction.

* * * * *